US006860314B1

(12) United States Patent
Koide et al.

(10) Patent No.: US 6,860,314 B1
(45) Date of Patent: Mar. 1, 2005

(54) METHOD FOR PRODUCING A COMPOSITE METAL PRODUCT

(75) Inventors: Atsushi Koide, Nagano-ken (JP); Kiyoto Takizawa, Nagano-ken (JP); Yoshitoshi Yamagiwa, Nagano-ken (JP); Masashi Suganuma, Nagano-ken (JP); Mamoru Miyagawa, Nagano-ken (JP)

(73) Assignee: Nissei Plastic Industrial Co. Ltd., Nagano-Ken (JP)

( * ) Notice: Subject to any disclaimer, the term of this patent is extended or adjusted under 35 U.S.C. 154(b) by 0 days.

(21) Appl. No.: 10/645,343

(22) Filed: Aug. 21, 2003

(30) Foreign Application Priority Data

Aug. 22, 2002 (JP) ..... 2002-242291

(51) Int. Cl.[7] ..... B22D 27/08
(52) U.S. Cl. ..... 164/113; 164/900; 164/97
(58) Field of Search ..... 164/113, 900, 164/312, 97

(56) References Cited

U.S. PATENT DOCUMENTS 5,040,589 A * 8/1991 Bradley et al. ..... 164/113
5,501,266 A * 3/1996 Wang et al. ..... 164/113
5,531,425 A * 7/1996 Skibo et al. ..... 266/208
6,098,700 A * 8/2000 Carden et al. ..... 164/312
6,151,198 A * 11/2000 Prater et al. ..... 360/265.7

* cited by examiner

*Primary Examiner*—Kiley S. Stoner
*Assistant Examiner*—Len Tran
(74) *Attorney, Agent, or Firm*—Weingarten, Schurgin, Gagnebin & Lebovici LLP

(57) ABSTRACT

A low melting point metal material is made to a thixotropic state in which liquid phases and solid phases coexists. In the thixotropic state of the low melting point metal material, a carbon nano material is kneaded with the low melting point metal material and forms a composite material. Thus obtained composite material is supplied to a metal molding machine and injected into a mold in a thixotropic state or a completely molten state of the metal so that the composite material fills the mold, thereby the composite material is molded to a composite metal product. With the above process, it is possible to injection mold the composite metal product to which the characteristics of the carbon nano material are applied.

12 Claims, 3 Drawing Sheets

METHOD FOR PRODUCING A COMPOSITE METAL PRODUCT

BACKGROUND OF THE INVENTION

1. Field of the Invention

The present invention relates to a method for producing a composite metal product from a composite material containing a carbon nano material and a low melting point metal material by injection molding.

2. Description of the Related Art

A carbon nano material, which is a kind of crystalline carbon materials, has such characteristics that its heat conductivity is five times or more as high as that of aluminum (Al), magnesium (Mg) and the like, it is excellent in electric conductivity, and it is also excellent in slidability because it has a low friction factor. Since the carbon nano material is very minute, however, it is said that the material is preferably used by being composited with other material.

In a conventional method, a composite material is obtained by mixing the carbon nano material and a metal powder, pressing and pulverizing said mixture so that the particle size is from 5 $\mu$m to 1 nm, and composit product is obtained by hot pressing the composite material. The above method has a problem in that metal products of electric equipments such as heat sinks, shields and bearings and the like, which are difficult to be molded by a hot press from the prior composite material containing the crystalline carbon material.

SUMMARY OF THE INVENTION

An object of the present invention, which has been devised to solve the above problems of the prior art, is to provide a novel method for producing a composite metal product from a composite material obtained by kneading a carbon nano material and a semi-molten low melting point metal material to form a composite material, injection molding the composite material containing a semi-molten state low melting point metal or a completely molten state low melting point metal to the composite metal product, and applying the characteristics of the carbon nano material to the composite metal product without being limited by the size and shape of the composite metal product so that the functions required to the composite metal product as a part of electronic equipment such as high heat conductivity, excellent electric conductivity, excellent slidability, and the like can be improved and to provide said composite metal product.

A method of the present invention for achieving the above object comprises a method for producing a composite metal product containing a carbon nano material and a low melting point metal material, comprising the steps of; preparing a molten low melting point metal material; cooling the molten low melting point metal material to a thixotropic semi-molten state in which liquid phases and solid phases coexist; forming a composite material by kneading the carbon nano material and the low melting point metal material in the thixotropic state; injecting the composite material into a mold in the thixotropic state by a molding machine having heating means; and obtaining the composite metal product.

The composite material to be supplied to the molding machine of the present invention comprises the low melting point metal material in a semi-molten state and the carbon nano material.

Further the composite material to be supplied to the metal molding machine of the present invention comprises a solid state material selected from the group consisting of granules such as pellets or chips, ingots and short columns and the low melting point metal contained in said composite material to be injected, is made to a semi-molten state by the metal molding machine having a heating means.

Also, the method of the present invention comprises a method for producing a composite metal product containing a carbon nano material and a low melting point metal material, comprising the steps of; preparing a molten low melting metal material; cooling the molten low melting point metal material to a thixotropic semi-molten state in which liquid phases and solid phases coexist; forming a composite material by kneading the carbon nano material and the low melting point metal material in the thixotropic state; injecting the composite material into a mold wherein the low melting point metal contained is in a completely molten state by a metal molding machine having a heating means; and obtaining the composite metal product.

The composite material to be supplied to the metal molding machine of the present invention comprises the low melting point metal material in a semi-molten state and the carbon nano material and said low melting point metal contained in said composite material to be injected is made to a completely molten state by the metal molding machine having a heating means.

The composite material to be supplied to the metal molding machine of the present invention also comprises a solid state material selected from the group consisting of granules such as pellets or chips, ingots and short columns, and the low melting point metal material contained in said composite material to be injected, is made to a completely molten state by the metal molding machine.

The present invention provide a composite metal product of a carbon nano material and a low melting point metal material, wherein the composite metal product comprises a metal product molded by the above method of the present invention.

The low melting point metal material in the present invention comprises at least one selected from the group consisting of metals, alloys of magnesium (Mg), tin (Sn), aluminum (Al), copper (Cu), lead (Pb), and zinc (Zn).

Further, the metal molding machine includes a so-called injection molding machine, a molding machine generically called a die cast machine, and the like, and these machines are generically called the metal molding machine. The injection molding machine is provided with an injection device having a heating cylinder or a melting cylinder, which has a nozzle at the head thereof and in which an injection screw or an injection plunger is disposed, and with a mold into which a molding material is injected in a molten state or in a semi-molten state by the injection screw or the injection plunger so that the molding material fills the mold.

Even though it is difficult to mix the carbon nano material with the metal material because the carbon nano material rises to the surface of the molten metal by being stirred on poor wettability of the carbon nano material to the metal material in a liquid phase, according to the present invention, kneading for the mixture of the carbon nano material and the low melting point metal material is performed in the thixotropic state (semi-molten state) in which liquid phases and solid phases coexist, and said rising to the surface of the molten metal is prevented by spheroidal solid phases (primary crystals) created in liquid phases (eutectic mixture). Therefore, the carbon nano material can be effectively composited with the low melting point metal material by being kneaded thereinto.

Further, the composite material is used as the molding material and molded to the composite metal product by being injected into the mold, the low melting point metal material contained in the composite material as the molding material being in the thixotropic state or in the completely molten state of the metal by the metal molding machine. As a result, it is possible to produce a composite metal product in which the carbon nano material is more uniformly dispersed in and composited with the low melting point metal material than a case in which a metal molding machine melts and blends the two materials as usual and injects them into a mold so that they fill the mold. Further, since the composite metal product is molded by injecting the composite material into the mold so as to fill it, the composite metal product has a high molded accuracy. Therefore, it is possible to easily mold a metal product having functions of high heat conductivity, excellent electric conductivity, low friction factor, and the like because the product is not limited in its shape and size different from a product molded by a press.

DESCRIPTION OF THE PREFERRED EMBODIMENTS

Figure 1:
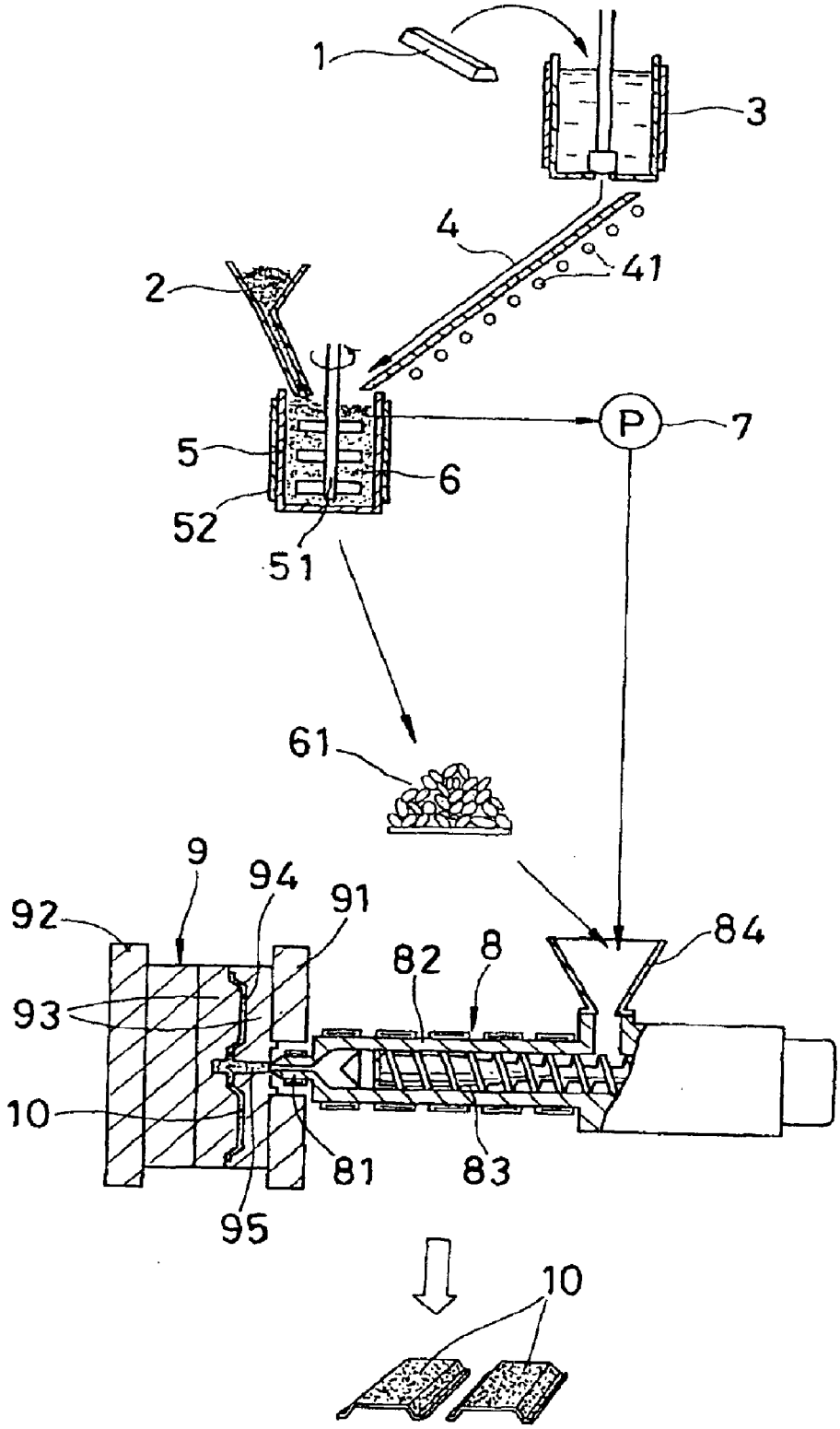
FIG. 1 is a process view of a method for producing a composite metal product containing a carbon nano material and a low melting point metal material according to the present invention.

A method of producing a composite metal product 10 will be explained below wherein said product is prepared from a metal material 1 consisiting of an alloy of magnesium as a base material and a carbon nano material 2 known as a carbon nano tube and the like as shown in FIG. 1. There is a carbon nano tube having a diameter of 10 nm (0.01 $\mu$m) and a length of 1 to 10 $\mu$m as a commercially available carbon nano tube.

First, the metal material 1 in a solid state is charged into a melting furnace 3 having a heating means and heated to a temperature equal to or higher than the melting temperature (600° C.) thereof so that the material 1 is completely melted to a liquid phase state. The metal material 1 in the liquid phase state is flown from the melting furnace 3 onto the upper surface of an inclining cooling plate 4 having cooling means 41 disposed downward of the melting furnace 3 and flown into a mixer 5 having stirring means 51 and heating means 52 disposed at the lower end of the cooling plate. In the process in which the metal material 1 flows down on the inclining cooling plate 4, the metal material 1 is cooled to a thixotropic state (semi-molten state), thereby a semi-solidified structure in which liquid phases (eutectic crystals) and spheroidal solid phases (primary crystals) coexist. Any arbitrary means other than the inclining cooling plate 4 may be employed as means for creating the thixotropic state.

Figure 2:
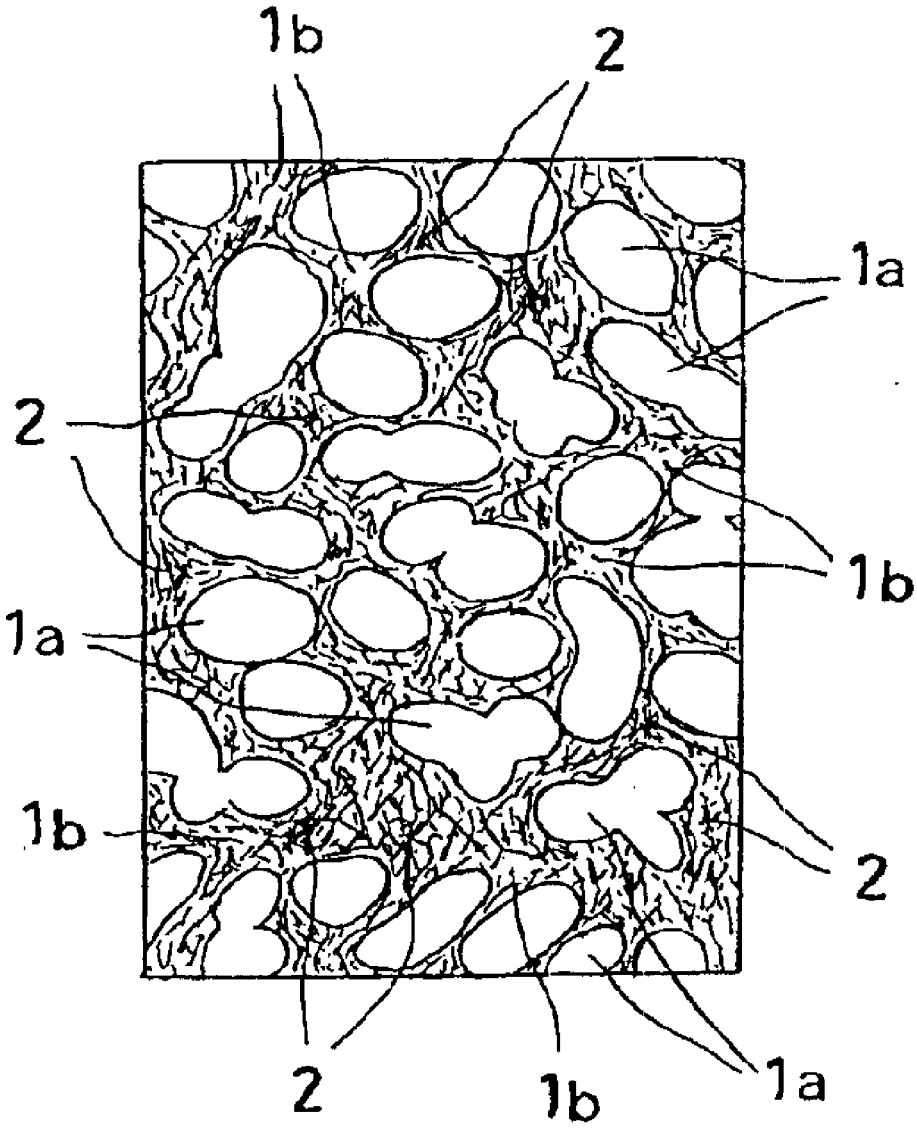
FIG. 2 is a view showing a semi-solidified structure of a composite material.

Next, the carbon nano material 2 is supplied from a hopper to the mixer 5 while keeping the temperature of the mixer 5 to about 570° C. by the heating means 52 disposed around the outer periphery thereof, and the metal material 1 in the thixotropic state and the carbon nano material 2 are stirred by stirring blades and mixed with each other. Since the temperature of the metal material 1 is kept in the mixer 5, as the solid phases 1*a* grow, the carbon nano material 2 is uniformly mixed with the liquid phases 2 around the solid phases 1*a* as shown in FIG. 2, thereby a composite material 6 composed of the magnesium-based alloy in the thixotropic state can be made.

The composite material 6, which is in the thixotropic state and has fluidity, is pumped up from the mixer 5 by a pump 7 with an automatic feeding unit and directly supplied as a molding material to a metal molding machine having an inline screw type injection machine 8 and a mold 9 for a product through a pipe line. The direct supply means described above can save material costs because it is not necessary to cool and solidify the composite material 6 and to make it to an ordinary granular material.

Further, although not shown, the composite material 6 may be cooled and solidified, formed to pellets, chips, or the like, and supplied as a granular molding material 61. In this case, material costs are increased as compared with the case in which the molding material is directly supplied. However, since the material can be stocked, it is not necessary to operate the metal molding machine as a molding system and the melting furnace 3 in parallel with each other and the material can be arbitrarily supplied according to an amount of production, thereby running costs can be reduced.

The injection device 8 has an injection screw 83 with a check valve disposed in a heating cylinder 82 having a nozzle 81 at the head thereof, and the injection screw 83 rotates and moves forward and rearward in the heating cylinder 82. Further, a hopper 84 is mounted on a supply port formed on the heating cylinder 82 at a rear portion thereof. The composite material 6 supplied from the hopper 84 into the heating cylinder 82 is heated by heating means disposed around the outer periphery of the heating cylinder 82 to a preset temperature, i.e. to about 570° C. when the composite material 6 is injected into and fills the mold 9 in the thixotropic state and to 600° C. or more when it is injected thereinto in the completely molten state regardless of the type of the material.

When the composite material 6 is a solid material, for example, a granular molding material 61 and injected in the thixotropic state, it is kneaded by the screw while being melted by the heating means disposed around the outer periphery of the heating cylinder 82. However, the composite material 6 is a molten material and directly supplied from a pipeline, it is only kneaded and only the thixotropic state thereof is maintained by the heating means. Any of the former and latter materials is fed under pressure to the head portion of the heating cylinder 82 by the rotation of the screw 83. After the molding material is metered (stored) in the thixotropic state in the head portion of the heating cylinder 82 as the screw 83 is moved rearward by internal pressure, it is injected into and fills the mold 9 in the thixotropic state as the screw 83 is moved forward. It is preferable that the inside space of the heating cylinder 82 be filled with an inert gas to prevent oxidation.

Further, when the injection and filling of the molding material 6 are executed in the completely molten state of the metal, the metal contained in the composite material 6 supplied into the heating cylinder 82 is entirely melted and blended by the heating means and the screw in rotation regardless of the type of the material supplied and, and is injected into and fills the mold 9 as the screw moves forward. In the injection and filling executed in the completely molten state of the metal, the viscosity of the material supplied is very low as comapared with a case in which the metal contained in the composite material is in a semi-molten state, and thus the material has good flowability.

Accordingly, it is possible to produce a composite metal product having a thin wall thickness of about 1.5 mm or a small or a composite metal product such as precision product having a complex shape even if an injection speed and a its temperature are set to the same as those employed when the metal contained in the material is in the semi-molten state.

The mold 9 is composed of a pair of open/close divided molds 93 attached to a stationary platen 91 and a movable platen 92 of a not shown mold clamping unit and has cavities 94 for forming two sets of products interior thereof and a sprue 95 which is located at the center of both the cavities 94 and against which a nozzle 81 is abutted. The composite material, wherein the metal is in the semi-molten state or in the completely molten state, is injected from the nozzle 81, fills both the cavities 84 from the sprue 85, thereby the composite metal products 10, in which the metal material 1 of the magnesium-based alloy is uniformly composited with the carbon nano material 2, are formed.

Although the composite metal products 10 are injection molded by employing the inline screw type injection device 8 in the above embodiment, molding efficiency can be improved by employing an injection device similar to a screw type preplasticization injection device that is used to mold a resin.

Figure 3:
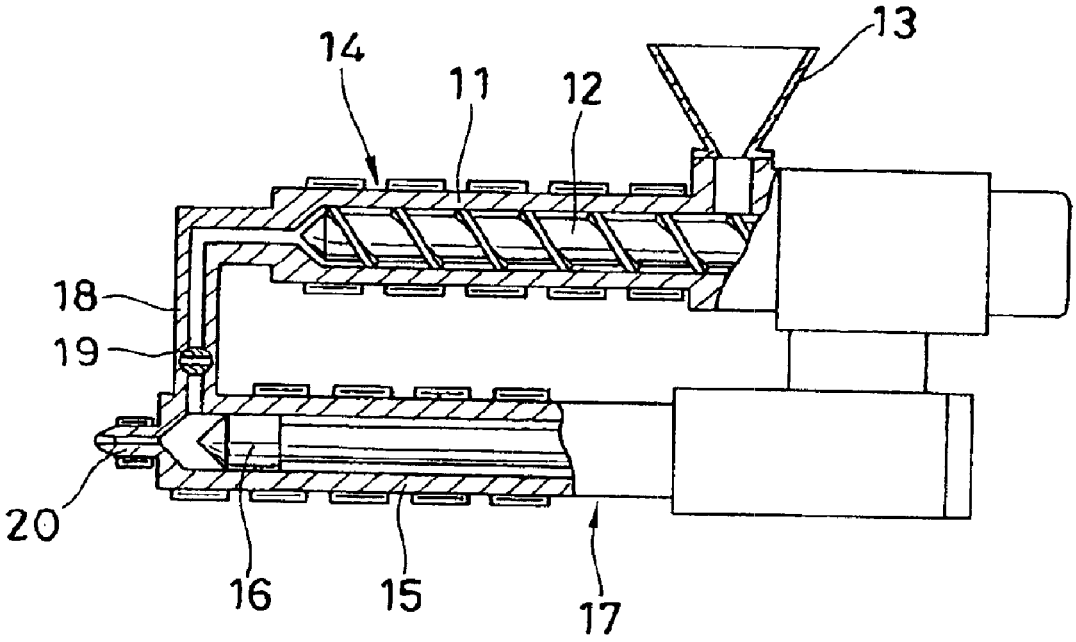
FIG. 3 is a schematic sectional view of a screw type preplasticization injection device for use in the method of the present invention.

As shown in FIG. 3, a screw type preplasticating injection machine ordinarily constructed includes a melting/kneading device 14 and an injection device 17 disposed in parallel with each other, and a flow path 18 having an open/close valve 19 is disposed between the head portions of the melting/kneading device 14 and the injection device 17 so that the melting/kneading device 14 communicates with the injection device 17 through the flow path 18. The melting/kneading device 14 has a melting/kneading cylinder 11 having a melting/kneading screw 12 disposed therein and a hopper 13 disposed on the cylinder 11 at a rear portion thereof, and the injection device 17 has an injection cylinder 15 including an injection plunger 16 forward and rearward movably disposed therein.

Accordingly, in an injection process, the composite material containing the molten material in the thixotropic state is only kneaded in the melting/kneading device 14 and maintained in the thixotropic state. The granular molding material 61 is melted and kneaded therein. Each of the the composite materials, wherein the metal is in the semi-molten state or in the completely molten state, is fed under pressure to the front portion of the injection cylinder 15 and weighed therein after it is melted or melted and kneaded. After the molding material is weighed, the open/close valve 19 of the flow path 18 is closed. In the injection device 17, the molten material is injected from a nozzle 20 into the mold 9 and fills the same as the injection plunger 16 moves forward. In the melting/kneading device 14, the molding material supplied thereto begins to be melted and kneaded while the injection and filling operation is executed in the injection device 17. With the above operation, the composite metal products 10, in which the carbon nano material 2 is uniformly composited with the metal material 1, can be effectively injection molded.

When the composite material is a solid material such as an ingot and a short columnar material (for example, magnesium alloy having a length of 300 mm and a diameter of 60 mm), a melting furnace (not shown) is disposed above the heating cylinder 8 shown in FIG. 1 or the melting/kneading device 14 on the rear side thereof so as to be connected thereto. The ingot or the short columnar solid material is melted to the semi-molten state by the melting furnace, supplied to the heating cylinder 8 or the melting/kneading unit 14 so that the metal is maintained in the semi-molten state or completely melted thereby, and then injected into the mold 9 from the heating cylinder 8 or the injection cylinder 15 and fills the same.

EXAMPLE

Composite Material (Chip)

Magnesium alloy (AZ91D)

Carbon nano tube (diameter: 0.01 $\mu$m, length: 1 to 10 $\mu$m)

| Temperature in injection and filling (set temperature) | |
|---|---|
| Semi-molten state | 580° C. |
| Completely molten state | 600° C. |
| Injection speed | |
| Semi-molten state | 200 mm/sec |
| Completely molten state | 200 mm/sec |
| Mold temperature | |
| Semi-molten state | 250° C. |
| Completely molten state | 250° C. |

What is claimed is:

1. A method for producing a composite metal product containing a carbon nano material and a low melting point metal material, comprising the steps of:

preparing a molten low melting point metal material;

cooling the molten low melting point metal material to a thixotropic semi-molten state in which liquid phases and solid phases coexist;

forming a composite material by kneading the carbon nano material and the low melting point metal material in the thixotropic state;

injecting the composite material into a mold in the thixotropic state by a molding machine having heating means; and obtaining the composite metal product.

2. The method according to claim 1, wherein the composite material to be supplied to the molding machine comprises the low melting point metal material in a semi-molten state and the carbon nano material.

3. The method according to claim 1, wherein the composite material to be supplied to the metal molding machine comprises a solid state material selected from the group consisting of granules such as pellets or chips, ingots and short columns and the low melting point metal contained in said composite material to be injected, is made to a semi-molten state by the metal molding machine having a heating means.

4. A method for producing a composite metal product containing a carbon nano material and a low melting point metal material, comprising the steps of:

preparing a molten low melting metal material;

cooling the molten low melting point metal material to a thixotropic semi-molten state in which liquid phases and solid phases coexist;

forming a composite material by kneading the carbon nano material and the low melting point metal material in the thixotropic state;

injecting the composite material into a mold wherein the low melting point metal contained is in a completely molten state by a metal molding machine having a heating means; and obtaining the composite metal product.

5. The method according to claim 4, wherein the composite material to be supplied to the metal molding machine comprises the low melting point metal material in a semi-molten state and the carbon nano material and said low melting point metal contained in said composite material to be injected is made to a completely molten state by the metal molding machine having a heating means.

6. The method according to claim 4, wherein the composite material to be supplied to the metal molding machine comprises a solid state material selected from the group consisting of granules such as pellets or chips, ingots and short columns, and the low melting point metal material contained in said composite material to be injected, is made to a completely molten state by the metal molding machine.

7. A composite metal product of a carbon nano material and a low melting point metal material, wherein the composite metal product comprises a metal product molded by the molding method according to claim 1.

8. A composite metal product of a carbon nano material and a low melting point metal material, wherein the composite metal product comprises a metal product molded by the molding method according to claim 2.

9. A composite metal product of a carbon nano material and a low melting point metal material, wherein the composite metal product comprises a metal product molded by the molding method according to claim 3.

10. A composite metal product of a carbon nano material and a low melting point metal material, wherein the composite metal product comprises a metal product molded by the molding method according to claim 4.

11. A composite metal product of a carbon nano material and a low melting point metal material, wherein the composite metal product comprises a metal product molded by the molding method according to claim 5.

12. A composite metal product of a carbon nano material and a low melting point metal material, wherein the composite metal product comprises a metal product molded by the molding method according to claim 6.

* * * * *